US005964234A

United States Patent [19]

Bailly et al.

[11] Patent Number: 5,964,234

[45] Date of Patent: Oct. 12, 1999

[54] DISPOSABLE UMBRELLA

[76] Inventors: Philippe Bailly, 59 Dearborn Rd., Norwood, N.J. 07648; Yannick Bailly, Allee des Sapins, Lamembrolle, Indre et Loire, France, 37390

[21] Appl. No.: 08/889,460

[22] Filed: Jul. 8, 1997

[51] Int. Cl.[6] ..... A45B 19/00; A45B 25/02; A45B 25/08

[52] U.S. Cl. ..... 135/19.5; 135/20.3; 135/27; 135/29; 135/39; 135/33.4

[58] Field of Search ..... 135/19.5, 20.3, 135/28, 37, 38, 39, 25.34, 31, 19, 27, 29, 33.2, 33.41

[56] References Cited

U.S. PATENT DOCUMENTS

| | | | |
|---|---|---|---|
| 1,484,367 | 2/1924 | Vincent . | |
| 1,547,538 | 7/1925 | Vincent . | |
| 1,697,520 | 1/1929 | Clark . | |
| 1,858,960 | 5/1932 | Krüger | 135/37 |
| 2,567,284 | 9/1951 | Hacken et al. . | |
| 2,667,884 | 2/1954 | Bruno et al. | 135/19.5 |
| 2,671,458 | 3/1954 | Goldstein et al. | 135/19.5 X |
| 2,747,592 | 5/1956 | Epstein . | |
| 4,062,369 | 12/1977 | Hermanson | 135/19.5 |
| 4,182,352 | 1/1980 | Hermanson | 135/19.5 |
| 4,215,711 | 8/1980 | Hermanson | 135/19.5 |
| 4,370,993 | 2/1983 | Desaleux | 135/19.5 X |
| 4,624,275 | 11/1986 | Baldwin . | |
| 5,085,239 | 2/1992 | Chin-Hung et al. | 135/28 X |
| 5,193,566 | 3/1993 | Chen | 135/28 |

*Primary Examiner*—Carl D. Friedman
*Assistant Examiner*—Brian E. Glessner
*Attorney, Agent, or Firm*—Natter & Natter

[57] ABSTRACT

A disposable umbrella having an elongated handle member for supporting a foldable canopy. A plurality of rib members are positionable along the underside of the canopy. A collar member is slidable along the handle and is registrable with a cam surface on the rib members for urging the rib members to open the canopy. The collar member is press-fit into friction-locking engagement with the rib members to releasably retain the canopy in the open position. The collar member, the plurality of rib members and the canopy are assembled on the handle member and secured by an end cap that is lockingly engageable with the handle member.

8 Claims, 3 Drawing Sheets

FIG. 1
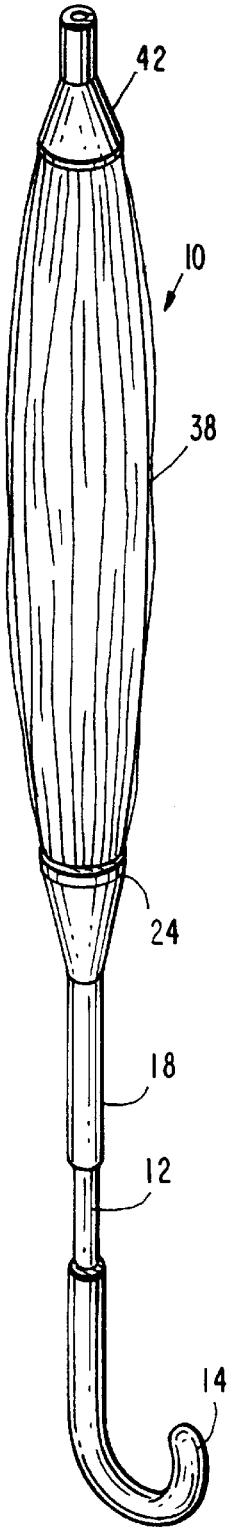
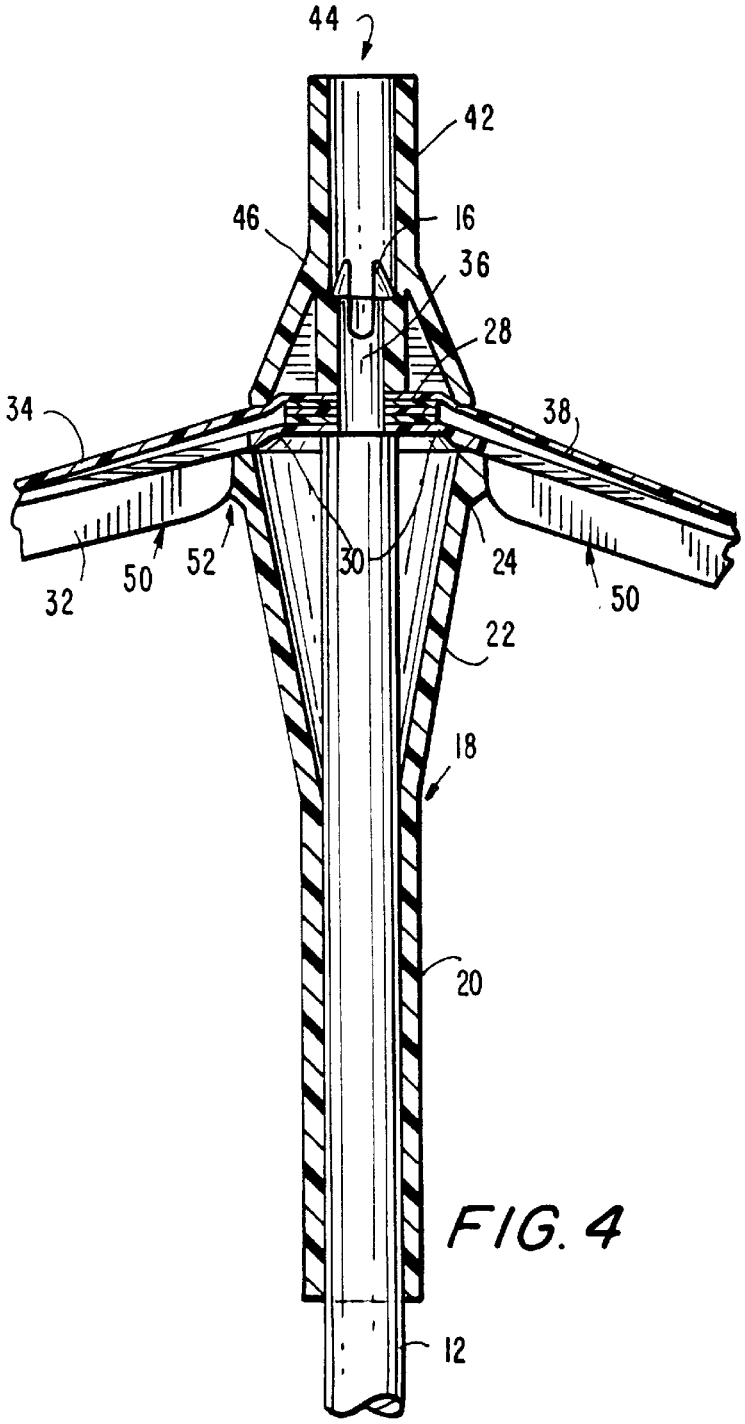
FIG. 4

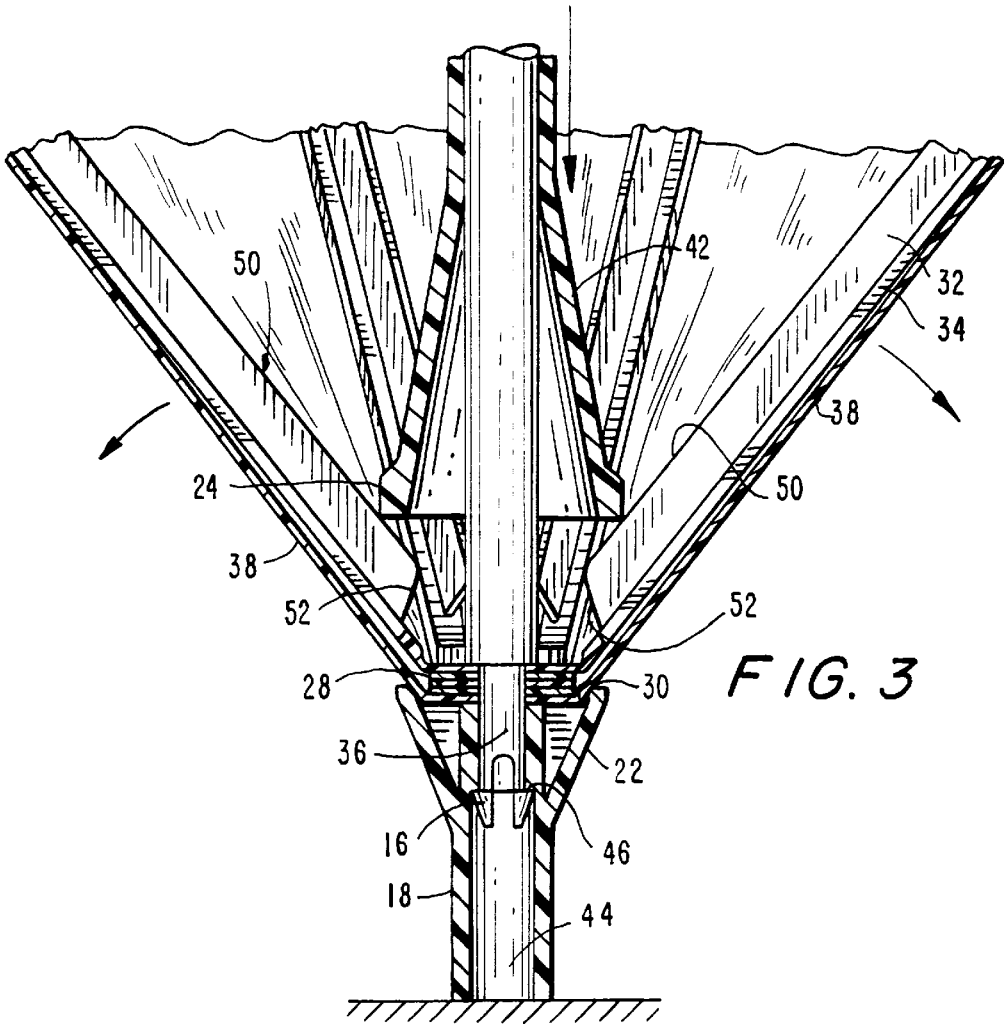
FIG. 3
FIG. 5
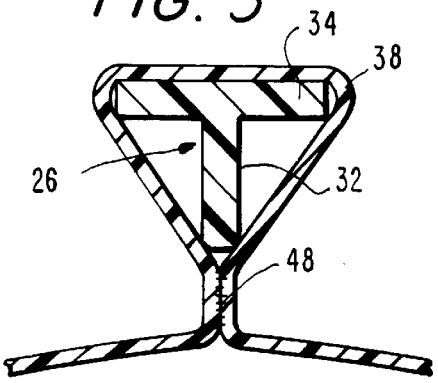
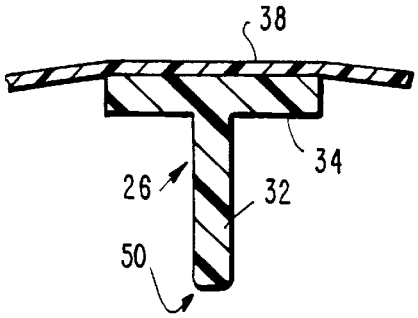
FIG. 6

DISPOSABLE UMBRELLA

BACKGROUND OF THE INVENTION

1. Field of the Invention

This invention relates generally to sunshades, rain-shields, and especially to umbrellas.

In particular, this invention concerns a disposable umbrella having a friction-lock arrangement for opening and closing a canopy.

2. Background of the Invention

Umbrellas conventionally employ a canopy supported by an elongated handle. The canopy is typically maintained in an open position by ribs that are held in place by a spring latch mechanism as typically illustrated in U.S. Pat. Nos. 1,484,367, 1,574,538 and 1,697,520.

Another latch mechanism, in the form of a bayonet slot and pin is shown in U.S. Pat. No. 1,858,960. A further latch device, as disclosed in U.S. Pat. No. 2,567,284, utilizes a spring collar mechanism.

The opening and closing mechanisms of these umbrellas contribute to the manufacturing cost in terms of both materials and labor and generally would not be economically justifiable for a limited-use umbrella.

Although U.S. Pat. No. 2,747,592 shows use of frictional engagement to hold an umbrella open, the telescopic tube arrangement of that device does not lend itself to a simplified assembly having a minimum of components as in the present invention.

SUMMARY OF THE INVENTION

The nature of this invention concerns a limited-use umbrella and method of assembly.

Briefly, the disposable umbrella of this invention is comprised of an elongated handle member which supports a protective canopy. The canopy is displaceable from a folded, closed position to an extended, open position. The opening and closing is effected by a collar member that is selectively slidable along the handle. A plurality of rib members are positioned along the underside of the canopy and are coupled to and project radially from the handle member. The collar member includes a shoulder portion that is registrable with a cam surface of the rib member for urging and subsequently retaining the canopy in an extended position without the use of spring latches or similar hardware.

The handle member is adapted for accommodation within an end cap. The collar member, a plurality of rib members and the canopy are respectively assembled on the handle member prior to attachment to the end cap.

A feature of the disposable umbrella of this invention resides in the efficiency of manufacture and economy of cost whereby the umbrella can be produced and sold as a relatively inexpensive, throw-away item.

In view of the foregoing, it should be apparent that the present invention provides a disposable umbrella construction that does not involve a complexity of components, spring latch mechanisms, or similar hardware.

Having thus summarized the invention, it will be seen that it is a preferred object thereof to provide an improved disposable umbrella that is designed for cost-effectiveness and efficiency of operation.

It is a further preferred object of this invention to provide a disposable umbrella having a friction-locking arrangement for opening and closing the canopy.

Another preferred object of this invention is to provide a disposable umbrella having a snap-fit assembly.

It is a further preferred object of this invention to provide a disposable umbrella that is simple in design, reliable in operation, attractive in appearance, and economical to manufacture.

Other preferred objects of this invention will in part be apparent and in part will be pointed out hereinafter.

With these ends in view, the invention finds embodiment in certain combinations of elements and arrangements of parts by which the aforementioned preferred objects and certain other objects are hereinafter attained all as more fully described with reference to the accompanying drawings the scope of which is more particularly pointed out and indicated in the appended claims.

BRIEF DESCRIPTION OF THE DRAWINGS

In the accompanying drawings in which is shown an exemplary embodiment of the invention:

FIG. 1 is a perspective view in elevation showing a disposable umbrella in accordance with this invention, with a canopy in a folded or closed position;

FIG. 3 is a partial sectional view, to an enlarged scale, illustrating by the arrows, slidable movement of a collar member along a handle member and corresponding displacement of a plurality of rib members for extending the canopy to an open position;

FIG. 4 is a partial sectional view, to an enlarged scale, showing the collar member in friction-locking engagement with the rib members for retaining the canopy in the open position;

FIG. 5 is a sectional view, to an enlarged scale, taken substantially along line 5—5 of FIG. 2 showing a rib member terminal attached to the canopy at the margin of the canopy; and FIG. 6 is a sectional view, to an enlarged scale, taken substantially along line 6—6 of FIG. 2 showing the rib member having a flange contiguous to an underside surface of the canopy.

DESCRIPTION OF THE PREFERRED EMBODIMENT

Figure 2:
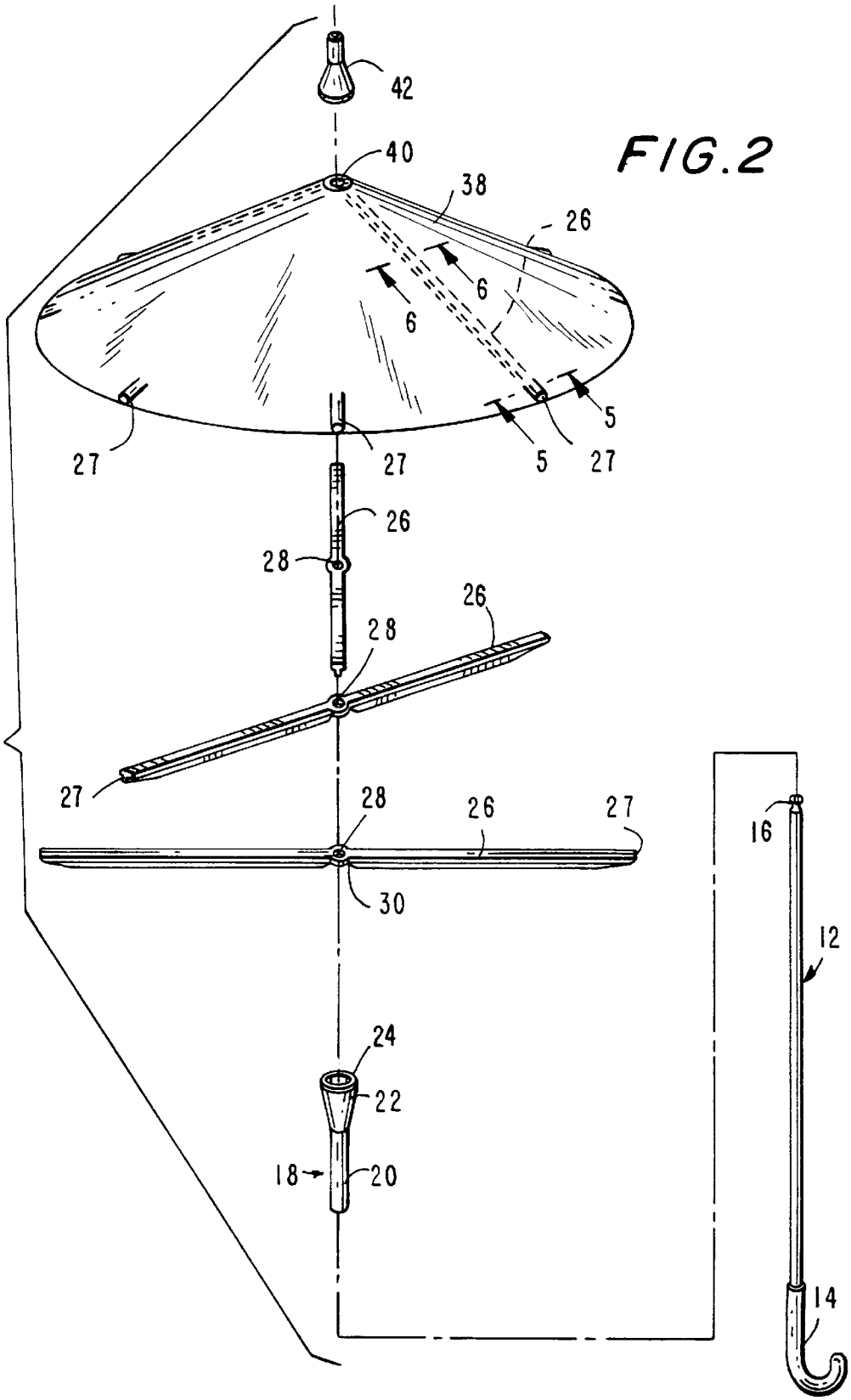
FIG. 2 is an exploded elevational view, in perspective, showing the assembly relationship of the several components thereof.

With specific reference now to the figures in detail, it is stressed that the particulars shown are by way of example and for the purpose of illustrative discussion of the preferred embodiment of the present invention only and is presented in the cause of providing what is believed to be the most useful and readily understood description of the principles and conceptual aspects of the invention. In this regard, no attempt is made to show structural aspects of the invention in more detail than is necessary for a fundamental understanding of the invention, the description taken with the drawings making apparent to those skilled in the art how the invention may be embodied in practice.

Although the invention will be described with reference to use as an umbrella, it should be understood that the device is applicable for other uses such as a sunshade, a parasol, or any similar covering.

With regard to this exemplary embodiment, FIG. 1 shows a disposable umbrella 10 in an unopened mode. The umbrella 10 is preferably fabricated of a thermoplastic material that can be injection molded. As best shown in FIG. 2, the umbrella 10 includes an elongated handle member 12, preferably in the form of a rod. One end of the handle member is provided with a U-shaped hand grip 14. An opposite end of the handle member 12 is provided with a bifurcated spring-action tip member 16, which will be further discussed hereinafter.

A collar member 18 is slidably mounted on the handle member 12 and includes a substantially cylindrical section 20 that merges into a substantially conical section 22. An uppermost margin of the conical section 22 defines a shoulder 24.

A plurality of rib members 26 are coupled to the handle member 12. The rib members 26 each include an aperture disc 28, an integral hinge 30 for providing transverse flexibility e.g. a "living hinge", and a rigid body portion having a "T" cross-section with a stem 32 and a flange 34 as best shown in FIGS. 5 and 6. The disc 28 of the several rib members 26 are coupled to a shaft 36, formed by a reduced diameter necked-down portion of the handle member 12. A plurality of discs 28, are assembled in a stacked relationship to provide limited rotational displacement about the shaft 36.

A canopy 38, preferably comprised of a substantially circular segment of plastic sheet material, other water impervious fabric, or similar coverings, is provided with a central aperture 40 for placement on the shaft 36.

An end cap 42 is provided with a passageway 44 having a reduced internal diameter along a portion of its length defining an internal boss 46. The handle member 12 is attachable to the end cap 42 by inserting the tip member 16 into the passageway 44. During entry the tip member 16 will be compressed and will resume its pre-compressed configuration after reaching an entry distance that is beyond the boss 46 to provide a snap-fit locking engagement with the cap 42. It should further be noted, as an assembly feature, that the canopy 38, the discs 28 and the rib members 26 are each coupled to the shaft 36, as shown in FIGS. 3 and 4, prior to engaging the tip member 16 within the end cap 42.

Referring now to FIGS. 2 and 5, a terminal 27 at a distal end of each of the rib members 26 is anchored to a margin of the canopy 38, preferably at substantially equal distances along the circumference. In this illustrative embodiment, the canopy 38 is gathered around the terminal 27 and is secured by a seam 48 that is formed by heat-sealing. The canopy 38 can also be stitched, stapled or bonded for attachment to the terminal 27.

The flange 34 is contiguous to an underside surface of the canopy 38 and provides support for the canopy 38. When it is desired to open the canopy 38, the collar member 18 is slidably displaced toward the end cap 42 which is preferably placed upon a firm support surface as shown in FIG. 3. As the collar member 18 is slid along the handle member 12, the shoulder 24 engages a substantially linear cam surface 50 defined by an edge of the stem 32. The cam surface 50 converges with an arcuate cam surface 52 at a proximal end of the rib member 26. The shoulder 24 exerts a displacement force on the rib members 26 which in turn, extends the canopy 38. When the shoulder 24 reaches the arcuate cam surface 52 it is press-fit between the arcuate cam surface 52 of the respective rib members 26, as shown in FIG. 4, to provide a friction-lock. The collar member 18 thus releasably holds the rib members 26 in a locked position. Any rotational forces that may act on the rib members 26 will be neutralized by relative displacement of the discs 28 about the shaft 36.

When it is desired to close the umbrella 10, a force directed toward the hand grip 14, is exerted on the conical portion 22 of the collar member 18 for releasing the shoulder 24 from the arcuate cam surface 52. The canopy 38 can then be folded, by hand, with the rib members 26 being pivoted about the hinge 30, and the terminals 27 of the rib members 26 being seated within the confines of the collar 18 as shown in FIG. 1.

It should thus be seen that there is provided a disposable umbrella which achieves the various preferred objects of the invention and which is well adapted to meet conditions of practical use.

Since various possible embodiments might be made of the present invention or modifications might be made to the exemplary embodiments set forth above, it is to be understood that all materials shown and described in the accompanying drawings are to be interpreted as illustrative and not in a limiting sense.

Having thus described the invention, there is claimed as new and desired to be secured by Letters Patent:

1. An umbrella assembly comprising elongated handle means, said handle means defining a tip member at a first end and a hand grip at a second end, rib means including a disc portion having at least one rib member projecting radially from said disc portion, a plurality of said disc portions being mountable in stacked relationship on the handle means proximate the first end, said rib member further being hingedly displaceable about the disc portion from a first position substantially parallel to the handle means to a second position substantially perpendicular to the handle means, a collar member being slidable along the handle means for urging the rib member from the first position to the second position, said collar member further being adapted for frictionally engaging and selectively holding the rib member in the second position, a canopy secured to the rib member, and an end cap member being engageable with the tip member for securing the umbrella assembly.

2. An umbrella assembly as claimed in claim 1 wherein an edge of the rib member defines a substantially linear cam surface, said collar member being registrable with the cam surface for slidably urging the rib member to the second position, said collar member being further engageable with an arcuate portion of the cam surface for holding the rib member in the second position.

3. An umbrella assembly as claimed in claim 1, wherein the tip member is adapted for snap-fitting engagement with the end cap member.

4. An umbrella assembly as claimed in claim 1, wherein at least two rib members project radially from the disc portion.

5. An umbrella assembly as claimed in claim 1, wherein the rib member is hingedly connected to the disc portion.

6. An umbrella assembly as claimed in claim 1, wherein the canopy is anchored, at selected locations along a margin thereof, to a terminal end of the rib member.

7. An umbrella assembly as claimed in claim 1, wherein a terminal end of the rib member is confinable within the collar member when the rib member is in the first position.

8. A disposable umbrella comprising an elongated handle member, said handle member having a handgrip at a first end, a second end of said handle member being adapted for accommodating a plurality of disc members, said disc members being mounted in stacked relationship on the handle member at a predetermined distance from the second end, said disc members further including radially projecting rib members, said rib members being hingedly connected to respective disc members for movement from a retracted position substantially parallel to the handle member to an extended position substantially perpendicular to the handle member, said rib members further defining a cam surface, a canopy secured to the rib members, a collar member slidably mounted on the handle member for translation between the handgrip and the disc members, said collar member being adapted to exert a translative force on the cam surface of the rib members for urging the rib members from the retracted position to the extended position, said collar member further being adapted to frictionally engage and releasably hold the rib members in the extended position whereby the canopy is deployed.

* * * * *